United States Patent [19]

Hadank et al.

[11] Patent Number: 4,712,376

[45] Date of Patent: Dec. 15, 1987

[54] PROPORTIONAL VALVE CONTROL APPARATUS FOR FLUID SYSTEMS

[75] Inventors: John M. Hadank, Dunlap; Todd D. Creger, Peoria, both of Ill.

[73] Assignee: Caterpillar Inc., Peoria, Ill.

[21] Appl. No.: 921,506

[22] Filed: Oct. 22, 1986

[51] Int. Cl.[4] ..... F16D 31/02

[52] U.S. Cl. ..... 60/427; 60/428; 60/452; 60/484

[58] Field of Search ..... 60/433, 459, 420, 427, 60/484, 452, 428

[56] References Cited

U.S. PATENT DOCUMENTS

| | | | |
|---|---|---|---|
| 3,589,130 | 6/1971 | Ludwigsburg et al. | 60/52 |
| 3,987,622 | 10/1976 | Johnson | 60/420 |
| 4,024,710 | 5/1977 | Zelle | 60/420 |
| 4,102,132 | 7/1978 | Palmer | 60/484 |
| 4,147,034 | 4/1979 | Johnson | 60/422 |
| 4,369,625 | 1/1983 | Izumi et al. | 60/327 |
| 4,395,199 | 7/1983 | Izumi et al. | 417/53 |
| 4,498,847 | 2/1985 | Akiyama | 417/216 |
| 4,507,057 | 3/1985 | Igarashi et al. | 417/216 |
| 4,586,331 | 5/1986 | Ohman | 60/427 X |

*Primary Examiner*—Edward K. Look

*Attorney, Agent, or Firm*—Robert E. Muir

[57] ABSTRACT

An apparatus for controlling the fluid flow delivered to work elements of a work vehicle. In the operation of hydraulic work vehicles, when quick or multiple implement movement is required, the fluid pumps often are requested to surpass their capability in providing fluid flow to the work elements. A flow-limiting situation then occurs wherein some of the work elements are not receiving the requested flow and therefore cannot perform their requested functions. To solve this problem, the total available flow and the total requested flow from the pumps are monitored. If the total requested flow is not great enough to cause a flow-limiting situation, the operators demands are communicated to control valves which control fluid flow to the respective work elements. However, if the total requested flow is greater than the total available flow, the operators demand signals are "scaled down" in order to prevent a flow-limiting situation. The signals are communicated to the control valves in proportion to the operator demand. Therefore, the work elements move precisely as the operator demands even under high load conditions. This apparatus proves particularly useful on machines such as hydraulic excavators, where multiple work elements are used simultaneously, and precise controllability is desired.

20 Claims, 4 Drawing Figures

WORK ELEMENT
WORK ELEMENT
WORK ELEMENT
WORK ELEMENT
WORK ELEMENT
PILOT VALVE
CONTROL VALVE
ELECTRONIC VALVE CONTROLLER
CONTROL ELEMENT
CONTROL ELEMENT
CONTROL ELEMENT
CONTROL ELEMENT
CONTROL ELEMENT
ENGINE PUMP CONTROL
+V

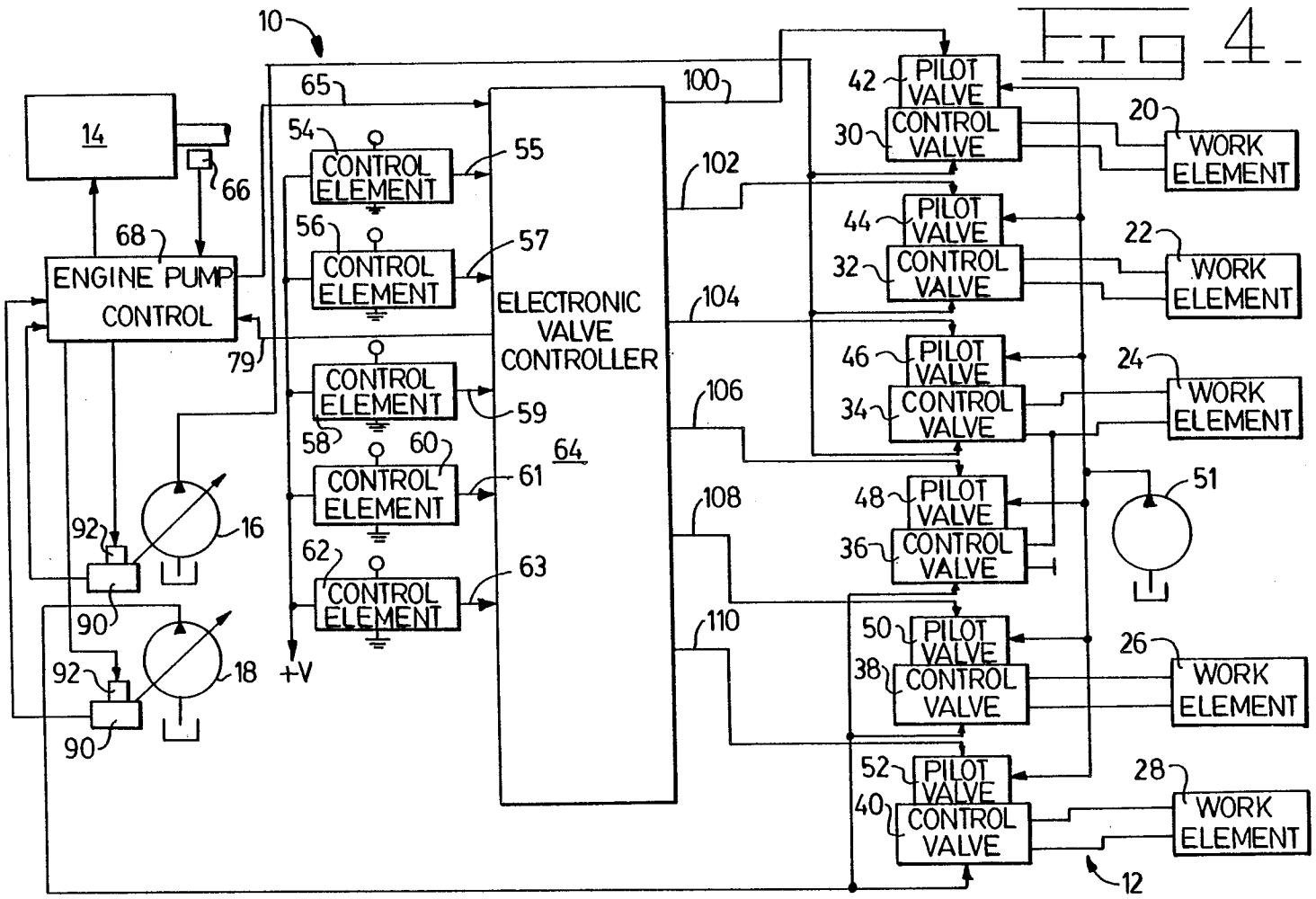
FIG. 4
WORK ELEMENT
WORK ELEMENT
WORK ELEMENT
WORK ELEMENT
WORK ELEMENT
PILOT VALVE
CONTROL VALVE
PILOT VALVE
CONTROL VALVE
PILOT VALVE
CONTROL VALVE
PILOT VALVE
CONTROL VALVE
PILOT VALVE
CONTROL VALVE
PILOT VALVE
CONTROL VALVE
ELECTRONIC VALVE CONTROLLER
CONTROL ELEMENT
CONTROL ELEMENT
CONTROL ELEMENT
CONTROL ELEMENT
CONTROL ELEMENT
+V
ENGINE PUMP CONTROL
10
12
14
16
18
20
22
24
26
28
30
32
34
36
38
40
42
44
46
48
50
51
52
54
55
56
57
58
59
60
61
62
63
64
65
66
68
79
90
92
100
102
104
106
108
110

PROPORTIONAL VALVE CONTROL APPARATUS FOR FLUID SYSTEMS

TECHNICAL FIELD

This invention relates generally to a control system for a hydraulic work apparatus, and more particularly, to an electronic device used to control fluid flow to work elements in response to operator inputs and hydraulic pump capacity.

BACKGROUND OF THE INVENTION

In the operation of a fluid system serving a plurality of work elements, the work elements often demand large volumes of fluid from their associated hydraulic fluid pump. Situations arise where the work elements demand fluid at a rate greater than the capacity of the pump, thus flow-limiting occurs. In such situations, one or more of the work elements, for example, demand more fluid than they are capable of receiving, while another work element requires fluid at a very high pressure in order to continue function under its existing load.

In a series arrangement, the "upstream" work elements receive the needed fluid first, leaving the "downstream" elements to starve. In a parallel arrangement of work elements, the fluid follows the path of least resistance. Therefore, the elements having the lowest load pressures are supplied fluid first, leaving the work elements demanding a higher load pressure with an insufficient fluid flow.

From an operator's perspective, proportional control of the work elements is provided via "manual" controls (i.e., joysticks connected to a valve controlling means) while the pump or pumps are not flow-limited. Once the flow capacity of the pump or pumps is exceeded, however, the hydraulic system reverts to a fixed implement priority such as described above. In this state, controllability of the work elements is severely limited. Attempts by the operator to adjust his inputs correctly to avoid or overcome this state often lead to operator fatigue and poorer production. In addition, automatic functions, such as an auto dig cycle for an excavator, can not be implemented on such a machine. When flow limiting occurs during an automatic function cycle, the machine stalls or incorrectly performs the function.

This problem associated with a plurality of work elements can be solved by implementing a pump or system of pumps having a capacity greater than the total demand capacity ever required by the work elements. However, the resultant pump or system of pumps is prohibitively large, expensive, and inefficient. Additionally, the extra weight causes the vehicle to consume more fuel and be more costly to maintain.

It is, therefore, desirable to provide an apparatus which monitors and controls the system so as to anticipate a flow-limiting condition and automatically reduce fluid delivery rates to said work elements and maintain flow proportional to their individual actual demand.

The present invention is directed to overcoming one or more of the problems as set forth above.

DISCLOSURE OF THE INVENTION

In accordance with one aspect of the present invention, an apparatus controls the fluid system of a work vehicle. The work vehicle has a source of motive power and at least one fluid circuit which has a variable displacement pump driven by the source of motive power.

A plurality of control valves controllably pass fluid from the variable displacement pump to a plurality of respective work elements. A plurality of operator control elements provide demand signals in response to selected settings of each operator control element. A means senses the speed of the source of motive power and delivers a signal representative of the actual speed in response to the sensed speed. An electronic valve controller receives the actual speed signal and the demand signals and uses them to determine requested flows and available flow capacity of the variable displacement pump. It also compares the available and the requested flows and delivers output signals to the respective control valves in response to the comparison. The valves are selectively positioned to limit the total requested fluid flow to the respective work elements within the available flow capacity of the variable displacement pump.

In accordance with another aspect of the invention, an apparatus controls the fluid system of a hydraulic excavator. The excavator has a source of motive power and at least one fluid circuit which has a variable displacement pump driven by the source of motive power. A plurality of work elements are connected through respective pressure compensated control valves to the discharge of the variable displacement pump. A pilot pump is driven by the source of motive power and delivers pressure signals to proportional pilot pressure valves, which are connected between the discharge of the pilot pump and the respective pressure compensated control valves. A plurality of operator control elements provide demand signals to the proportional pilot pressure valves in response to selected settings of each respective operator control element. A means senses the speed of the source of motive power and delivers a signal representative of the actual speed in response to the sensed speed. A calculating means determines requested fluid flow through each of the control valves, in response to the respective demand signals and the substantially constant pressure drop across each of the control valves, and delivers a plurality of first signals representative of requested fluid flow through each of the respective control valves. A means sums the first signals to determine total requested fluid flow and delivers a signal representative of the total requested fluid flow. A first means determines the desired speed of the source of motive power in response to the total requested fluid flow signal. A second means compares the desired and actual speed signals and delivers an underspeed signal representative of the actual speed being less than the desired speed. A third means receives the actual speed and underspeed signals, determines the total available flow capacity of the variable displacement pump, and delivers a signal representative of the total available flow. A fourth means compares the total requested flow to the total available flow and delivers one of a second and third signal in response to the total requested flow being respectively greater and less than the total available flow. A fifth means receives the third signal and delivers requested signals such that the fluid flow through each control valve is maintained substantially equal to operator demand. A sixth means receives the second signal and computes compensation factors for each of the requested flow signals. The compensation factors reduce the total requested flow until it is substantially equal to the total available flow, and keep the compensated signals in direct proportion to the demand signals. Compensated signals are delivered in response to the second signal. A seventh means receives the compensated signals and the requested signals, computes allowable valve areas for each control valve in response to the respective signals, and delivers fourth signals representative of the valve areas. A control means delivers predetermined signals to each of the respective control valves representative of the fourth signals. These signals control the valves to maintain the total requested flow within the total available flow capacity of the variable displacement pump. The predetermined signals also control fluid flow through each control valve substantially in direct proportion to the respective operator demand signals.

In summary, the technical problem lies in the fact that traditional fluid systems with variable displacement pumps, which control a plurality of work elements, are subject to the operator demanding more fluid to the work elements than is available in the system. When the operator demands more fluid than is available the work elements receive the fluid depending on the geometry in which they are configured in the system with respect to the pump. For example, if they are configured in series with respect to the pump, the work elements nearest to the discharge of the pump receive the fluid first, leaving the furthest work elements to starve. Therefore, the work elements are not operating in proportion to operator demand.

To solve this problem, the fluid flow requested by the operator is limited to the total available flow in the system. This is accomplished by monitoring the available and requested flows in the system. When the operator requests more fluid than is available, his signals are reduced proportionally so that they do not request more fluid than the system can provide. In this way, the pumps do not become flow-limited and the flow delivered to the work elements remains in proportion to operator demand. This reduces operator fatigue because he no longer has to closely monitor the system and rely on his senses to avoid a flow-limiting situation. Productivity is also enhanced, since the machine can be pushed to its limit continuously. Furthermore, such a flow monitoring system facilitates automated functions, since flow is monitored to provide smooth work cycles.

BRIEF DESCRIPTION OF THE DRAWINGS

FIG. 4 is a diagrammatic view of another embodiment of a hydraulic system of this invention which has one or more pumps serving one or more circuits each having a plurality of parallel work elements.

BEST MODE FOR CARRYING OUT THE INVENTION

Figure 1:
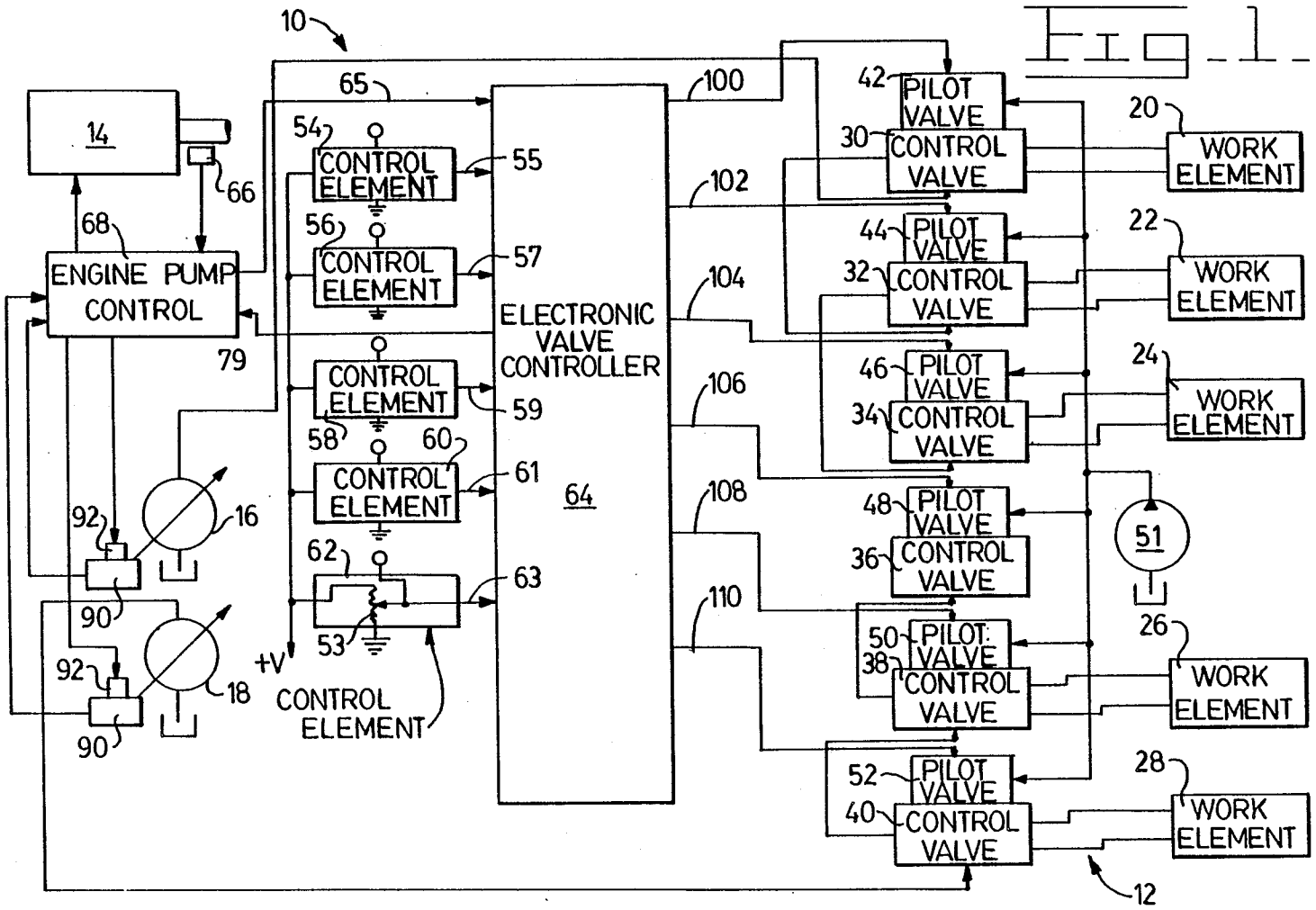
FIG. 1 is a diagrammatic view of one embodiment of a hydraulic system of this invention which has one or more pumps serving one or more circuits each having a plurality of serially connected work elements.

FIG. 1 illustrates a preferred embodiment of the proportional valve control apparatus 10. The fluid system 12 of a work vehicle, such as an hydraulic excavator or loader, includes a source of motive power 14, commonly an engine. The source of motive power drives one or more variable displacement pumps 16,18 which deliver fluid to a plurality of serially connected work elements 20,22,24,26,28.

Control valves 30,32,34,36,38,40 are placed in the fluid path between the variable displacement pumps 16,18 and their respective work elements 20,22,24,24,28,26 for controlling the fluid delivered to the work elements. The valves shown are pressure compensated valves which display a substantially constant pressure drop characteristic across the valve. Pressure compensated valves are known in the art as shown by U.S. Pat. Nos. 3,470,694 and 4,436,019, both issued to Budzich on Oct. 7, 1969 and Mar. 13, 1984, respectively. This known and substantially constant pressure drop is an important parameter which is used in later calculations.

Electrically actuatable valve opening means are associated with respective control valves 30,32,34,36,38,40, so that the fluid flow is controlled by electrical signals. Pilot valves 42,44,46,48,50,52 are connected between the pilot pump 54, which is driven by the source of motive power, and the respective control valves 30,32,34,36,38,40. The pilot valves deliver pressure signals to actuate the respective control valves. The electically actuatable pilot valves shown here are electrohydraulic proportional pilot pressure valves 42,44,46,48,50,52. These valves are known in the art, as shown in U.S. Pat. No. 4,524,947, issued to Barnes on June 25, 1985. Electrohydraulic proportional pilot pressure valves employ a solenoid that is proportionally actuated to a plurality of positions, using DC current, to vary pilot pressure of hydraulic fluid. This pilot pressure from pilot valves 42,44,46,48,50,52 is sent to the control valves 30,32,34,36,38,40, respectively, for proportionally displacing the valve stems and regulating flow from the variable displacement pump 16,18 to the respective work elements 20,22,24,24,28,26. However, any electrically actuatable valve could be implemented without narrowing the scope of the present invention.

Operator control elements 54,56,58,60,62, for example electronic joysticks, are connected to the electronic valve controller 64. The operator control elements provide demand signals which correspond to selected settings of each respective operator control element. For instance, a means 53, such as a potentiometer or digital converter, delivers distinguishable signals for different settings. These demand signals, indicative of operator demand for fluid flow to the work elements, are received by a means 70 of the electronic valve oontroller 64 on communication lines 55,57,59,61,63, respectively.

Additional information is provided by a speed sensing means 66, for example a device sensitive to the movement of gear teeth on an engine, as is known in the art. The device delivers a signal to the engine/pump control 68 representative of the actual speed of the source of motive power. This actual speed signal is sent via line 65 from the engine/pump control 68 to the electronic valve controller 64. Of course, this function could easily be implemented in a number of ways without the use of an interfacing control such as the engine/pump control 68. The engine/pump control 68 is discussed later in this specification.

The electronic valve controller 64 is a microprocessor based control, as are well known in the art, which utilizes programming logic for computing and decision making processes. The program is stored in read only memory. Algorithms, important to the function of the electronic valve controller, are shown in the flow chart of FIG. 2. These algorithims are substantially structured into first 67 and second 74 program means. The first program means 67 receives demand signals on the lines 55,57,59,61,63 and calculates the requested fluid flow through each control valve 30,32,34,36,38,40 in response to the respective demand signals. It sums the individual requested fluid flows to determine the total requested fluid flow 72 from each pump 16,18 and delivers a signal representative of of the total requested fluid flow. The second program means 74 compares the total requested flow and the available flow capacity, calculates compensated signals if the total requested flow is greater than the total available flow, and delivers compensated or requested signals to the control valves 32,34,36,38,40. These calculations maintain the total requested fluid flow within the available flow capacity of each variable displacement pump 16,18. The first program means 67 is functionally divided into a means 70 for determining the requested flow through each valve, and a means 72 for summing the individual flows to obtain a total requested flow. The second program means 74 is functionally divided into a means 77 for processing signals which do not cause a flow-limiting situation, and a means 81 for processing signals which would cause a flow-limiting situation.

Figure 2:
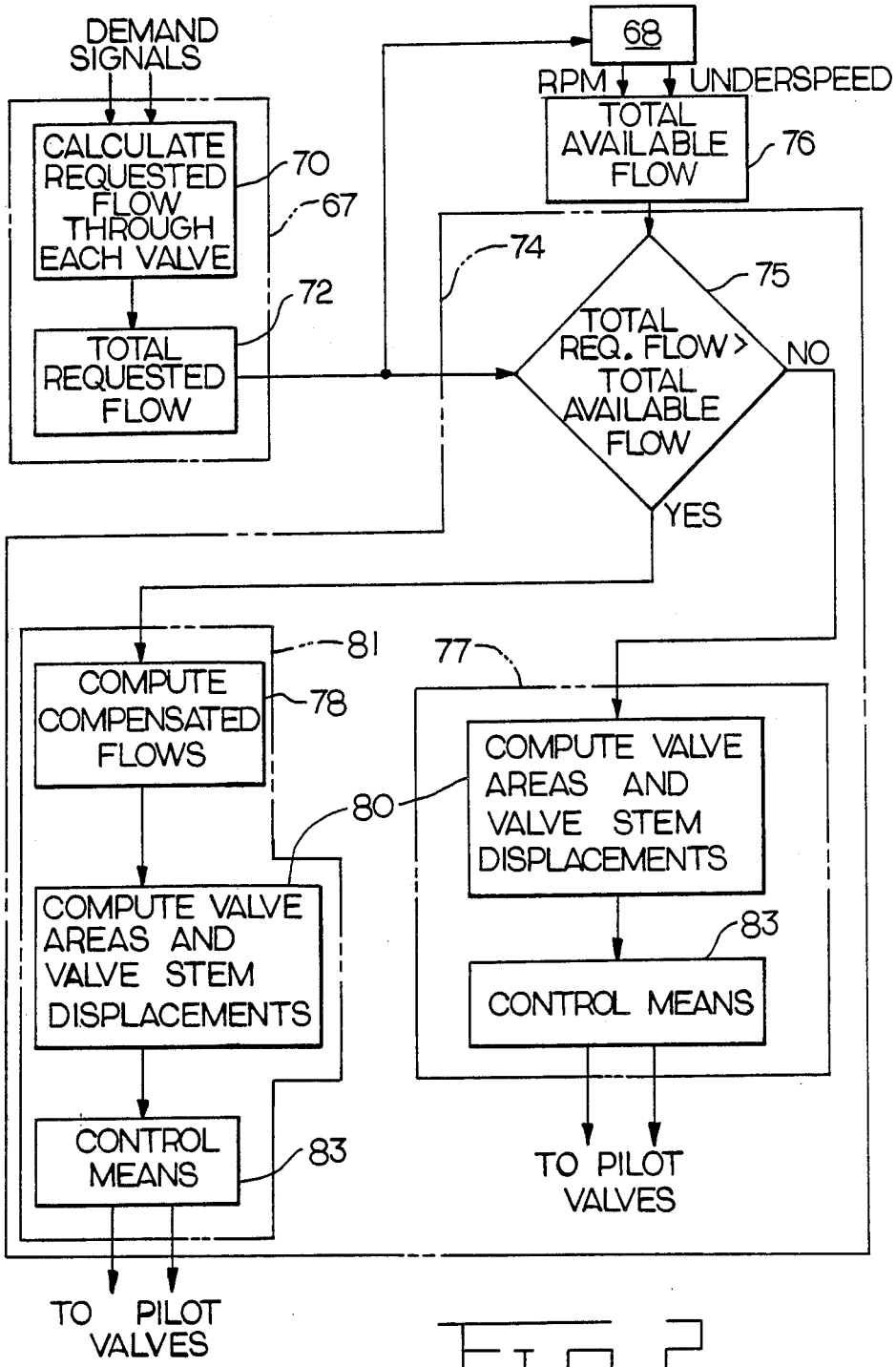
FIG. 2 is a flowchart depicting the algorithm used by an electronic system for controlling the valve stem displacements.

Referring now to FIG. 2, the electronic valve controller 64 uses the individual demand signals and the substantially constant pressure drop across the respective control valves to calculate the requested flow rates 70 through the respective control valves 30,32,34,36,38,40. A plurality of first signals are developed which correspond to the requested flow rate through each control valve 32,34,36,38,40. The electronic valve controller 64 sums the first signals to attain a value indicative of total requested flow 72 and delivers a signal in response thereto.

Figure 3:
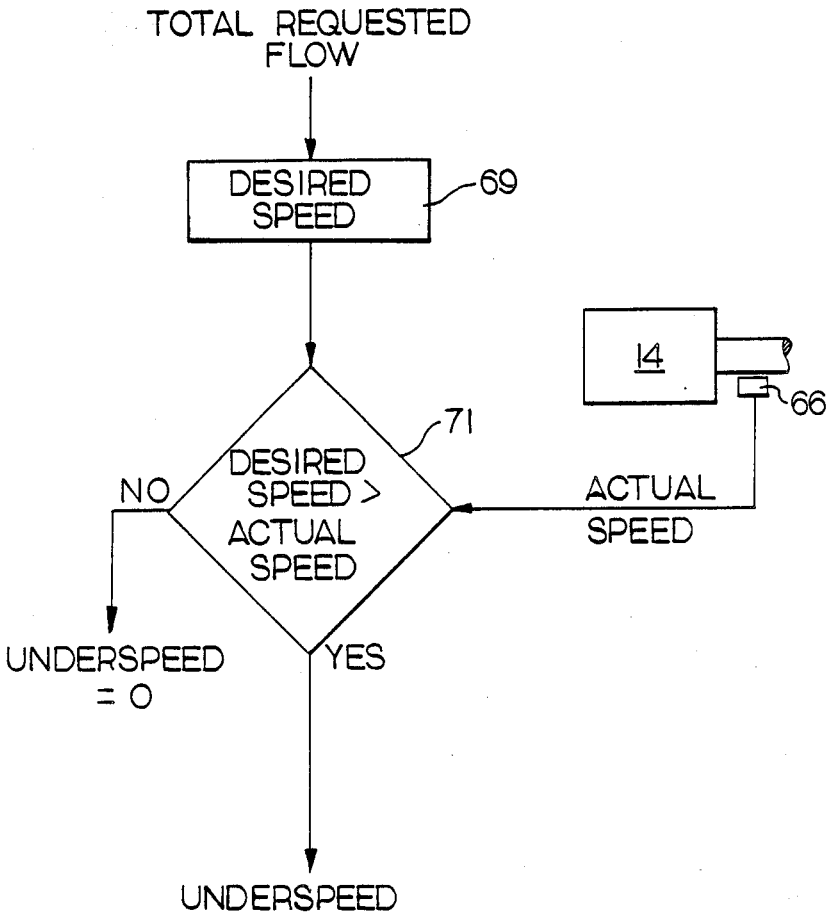
FIG. 3 is a simplified flow chart depicting an algorithm used by an electronic system for developing actual and desired engine speed signals and underspeed signals.

Referring to FIG. 3, a first means 69 for determining the desired speed of the source of motive power receives the total requested flow signal. This function is provided by an engine/pump controller 68, for example as disclosed in U.S. Pat. No. 4,534,707, issued to Mitchell on Aug. 13, 1985. The engine/pump controller 68 converts total requested flow 72 from each pump 16,18, received on line 79, into desired engine speed. Employing the value of total requested flow 72 to set desired engine speed, as opposed to a value indicative of pump displacement, provides measurable improvements in engine speed response. The engine/pump controller 68 is also a microprocessor based control, which has both read only and random access memory. This control utilizes a program, much like the electronic valve controller 64, for its computing and decision making processes. It should be noted that the use of the engine/-pump controller 68 with the proportional valve control enhances the functions of each and that both functions could easily be implemented into a single microprocessor based control. This enhancement does not detract from the scope of the present invention.

The engine/pump controller 68 provides additional benefits when coupled with the electronic valve controller 64. A second means 71, associated with the engine/pump controller 68, compares the desired speed value with the actual speed value and delivers an underspeed signal to the electronic valve controller 64 in response to the desired speed being greater than the actual speed. A third means 76 receives the underspeed signal and reduces the total available pump flow capacity proportional to the magnitude of the underspeed signal.

Referring again to FIG. 2, the third means 76 also receives the actual speed signal and the electronic valve controller 64 uses it to calculate total available flow capacity of each variable displacement pump 16,18. A fourth means 75 of the electronic valve controller 64 compares the total requested flow 72 with the total available flow 76 and delivers one of a second and third signal corresponding to the total requested flow 72 being respectively greater than and less than the total available flow 76.

A fifth means 77 of the electronic valve controller 64 is responsive to the third signal. If the total available flow 76 is greater than the total requested flow 72, the electronic valve controller 64 calculates the appropriate valve areas and valve stem displacements 80 in response to the individual requested flow signals. The control means 83 delivers signals to the respective proportional pilot valves 42,44,46,48,50,52, which displace the valve stems of the control valves 30,32,34,36,38,40 to the calculated positions. The requested flow signals correspond to the respective demand signals, in that the demand signals are converted into appropriate signals to facilitate the actuation of the pilot valves in the demanded fashion. Essentially, this function proportionally divides the total requested flow 72 among the control valves 32,34,36,38,40 according to the magnitude of the respective demand signals. Therefore, when the total requested flow 72 is not greater than the total available flow 76, a flow limiting situation will not occur, and the valves are actuated in magnitude and proportion to operator demand.

A sixth means 78 of the electronic valve controller 64 is responsive to the second signal. If the total requested flow 72 is greater than the total available flow 76, a flow limiting situation occurs in a traditional system. However, using the proportional valve control apparatus 10 the electronic valve controller 64 calculates compensation factors 78 for the requested flow rates 70 through each valve. The compensation factors 78 prevent the valves from requesting more flow than they could receive while keeping the individual valve flow rates directly proportional to the respective demand signals. Basically, this function reduces the total requested flow 72 until it is equal to the total available flow 76, and proportionally divides the total available flow 76 among the control valves 32,34,36,38,40 with respect to the respective demand signals. The following equations represent the type of calculations carried out to acheive these ends:

Q1=requested flow through control valve 32
Q2=requested flow through control valve 34
Q3=requested flow through control valve 38
C1=flow capacity of pump 16
C2=flow capacity of pump 18
C1 and C2 are functions of engine speed, underspeed, and pump efficiency
K=compensation factors $0 \leqq K \leqq 1$
K combined=(C1+C2)/(Q1+Q2+Q3)
K1=C1/Q1
K2=C2/Q2
K overall=Least (K com, K1, K2)
Determine main/crossover split ratio (control valves 36,38) and calculate compensated flows:
Q1c=K overall * Q1
Q2c=K overall * Q2
Q3c=K overall * Q3

Q main = C1 − Q2c
Q cross = Q3c − Q main
Ratio = Q main/Q3c

It should be noted in these equations that the flow capacity of each pump is calculated. This is done because of the plurality of fluid circuits. Since each circuit is fed by a pump, each circuit must be considered to prevent a flow-limiting situation from occuring. For ease of description, most of the specification limits discussion to a single fluid circuit. It is understood, however, that calculations are performed on all fluid circuits and combined to prevent flow-limiting situations in all fluid circuits.

A seventh means 80 of the electronic valve controller 64 uses the compensated flows and the requested flows to compute the allowable valve areas. From these, valve stem displacements are calculated for each respective control valve 30,32,34,36,38,40, and a plurality of fourth signals are sent. A control means 83 receives the fourth signals, and delivers signals on lines 100,102,104,106,108,110 representative of the calcualated valve stem displacements to actuate the respective pilot valves 42,44,46,48,50,52 and alter control valves 30,32,34,36,38,40 respectively.

As a result of these calculations, the control valves 32,34,36,38,40 are prevented from requesting more fluid flow than the variable displacement pumps are capable of providing, while maintaining a proportional relationship with the respective demand signals and improving operator controllability.

By using a load sensing hydraulic system, as known in the art and referenced by U.S. Pat. No. 4,534,707, issued to Mitchell on Aug. 13, 1985, the proportional valve control system displays additional benefits. A system of this type senses the load on the work elements, delivers signals representative of the sensed load, receives the signals, and alters the flow from the variable displacement pumps 16,18 in response to the load signals.

By incorporation of the proportional valve control with load sensing hydraulics, an engine underspeed actuation control is no longer needed, because it is inherent in a system of this kind. As the proportional valve control adjusts the valves 32,34,36,38,40 by the process described earlier in this specification, the load sensing means 90 senses the load on the work cylinders and an actuator means 92 adjusts the variable displacement pumps 16,18 for greater or less flow in response to the load on the work elements being respectively increasing or decreasing, and provides the requested flow being demanded by the system.

When the proportional valve control restricts the valve areas, the load sensing hydraulics destroke the pumps 16,18 because less flow is being requested. For example, should the engine speed drop below the desired speed, flow capacity of the pumps 16,18 decreases and causes the proportional valve control to reduce the valve areas 32,34,36,38,40 and prevent flow-limiting. Less flow is needed as the valve areas become smaller, so the load sensing hydraulic system causes the pump to destroke, thus unloading the engine proportionally and allowing it to regain desired speed.

FIG. 4 illustrates another embodiment of proportional valve control. Similar elements are numbered the same as FIG. 1. In this case, the system is identical to that of the previously described system except the control valves and work elements are connected in parallel with respect to the pumps. However, the electronic valve control, the engine/pump control, and load sensing hydraulics still operate in the manner set forth above.

To summarize the operation of the proportional valve control, signals are received from operator control elements from which desired engine speed and requested fluid flow are calculated. From an engine speed signal, actual speed and available fluid flow are calculated. Total available and total requested flows are compared.

When requested flow does not exceed available flow, signals are sent to the electronically actuated proportional pilot pressure valves 42,44,46,48,50,52 which in turn control the flow through the pressure compensated control valves 30,32,34,36,38,40 respectively. These signals are indicative of the actual demand from the operator, in both proportion and magnitude. However, when desired flow does exceed available flow, more calculations are needed to prevent the pumps from becoming flow-limited. Compensation factors are calculated in proportion to operator inputs, and the allowable valve areas are computed and utilized to keep said areas in proportion to the respective operator requests and also prevent a flow-limiting situation.

Industrial Applicability

The proportional valve control is useful on hydraulic work vehicles possessing a plurality of work elements, such as an hydraulic excavator. Excavators are versatile work vehicles that are used in a large number of applications. When an excavator is involved in a pipe laying process, for example, hydraulic cylinder movements are slow. This type of work requires relatively low cylinder loads and precise positioning of the load, so the excavator functions exactly as the operator demands. In such situations, the pump flow capacity is not exceeded and all work elements receive the requested fluid flow.

In most applications, however, the excavator must perform quickly, possibly under high loads. One such example is the digging of virgin soil. In this situation, the stick, bucket, and boom cylinders are used concurrently throughout the majority of the dig cycle. Often, especially when pivoting quickly to dump the load, the operator requests more total flow for the work cylinders than the pump is capable of providing. In a conventional machine, one or more of the work cylinders does not receive sufficient flow, due to the increased demand of another work cylinder. As a result, the starved work cylinders discontinue to function in proportion to operator demand, causing a poorly executed function. Additionally, operators experience fatigue attempting to avoid or overcome such situations.

Conversely, the proportional valve control avoids such work element starvation. In essence, it acts as a highly experienced operator in that it avoids flow limiting situations and maintains proportionality with operator demands on the individual work cylinders. Staying with the above mentioned soil dig example, the advantages of the proportional valve control become evident. At some point during the dig cycle, the operator requests more total flow to the work cylinders than the pump is capable of providing. Using the calculations described earlier in this specification, the proportional valve control recognizes this overdemand on the pump. To prevent a flow-limiting situation from occurring, the operator inputs are "scaled down" before they reach the control valves which control fluid flow to the work cylinders. In this way, all work cylinders function in proportion to the operator demands and the pumps never become flow-limited, thus facilitating a smoother dig cycle and less operator fatigue.

Other aspects, objects, and advantages of this invention can be obtained from a study of the drawings, the disclosure and the appended claims.

We claim:

1. An apparatus for controlling a fluid system of a work vehicle having a source of motive power, at least one fluid circuit having a variable displacement pump driven by the source of motive power, a plurality of control valves for controllably passing fluid from the variable displacement pump to a plurality of respective work elements, and a plurality of operator control elements, the apparatus comprising:

means for sensing the speed of said source of motive power and delivering a signal representative of the actual speed in response to said sensed speed;

means for providing demand signals in response to selected settings of each respective operator control element; and an electronic valve controller for receiving the actual speed signal and the demand signals, determining available flow and requested flow capacities of said variable displacement pump in response to the respective actual speed and demand signals, comparing the requested flow to the available flow capacity, delivering output signals to the respective control valves in response to said comparison, selectively positioning the valves, and limiting the total requested fluid flow to said respective work elements within the available flow capacity of the variable displacement pump.

2. Apparatus, as set forth in claim 1, wherein said electronic valve controller includes means for proportionally dividing the total available flow in response to said respective demand signals when the total requested flow is greater than the total available flow, and adjusting said control valves in response to said proportional division.

3. Apparatus, as set forth in claim 1, wherein said electronic valve controller includes means for proportionally dividing the total requested flow in response to said respective demand signals when the total available flow is greater than the total requested flow, and adjusting the control valves in response to said proportional division.

4. Apparatus, as set forth in claim 1, wherein the control valves maintain a substantially constant fluid pressure drop between said variable displacement pumps and said respective work elements.

5. Apparatus, as set forth in claim 1, wherein said control valves include electrically actuatable valve opening means.

6. Apparatus, as set forth in claim 1, wherein said fluid system includes means for sensing load on said work elements and altering the flow from said variable displacement pumps in response to said sensed load.

7. Appartaus, as set forth in claim 1, wherein said apparatus includes first means for receiving said total requested flow signal, determining desired speed of the source of motive power in response to said received signal, and delivering a signal representative of the desired speed.

8. Apparatus, as set forth in claim 1, wherein said apparatus includes second means for comparing said desired and actual speed signals, and delivering an underspeed signal representative of the actual speed being less than the desired speed.

9. Apparatus, as set forth in claim 1, wherein said electronic valve controller includes means for receiving the underspeed signal, and altering said total available flow relative to the magnitude of said underspeed signal.

10. Apparatus, as set forth in claim 9, wherein said means reduces the total available flow in response to the underspeed signal.

11. An apparatus for controlling a fluid system of work vehicle having a source of motive power, at least one fluid circuit having a variable displacement pump driven by the source of motive power, a plurality of control valves for controllably passing fluid from the variable displacement pumps to a plurality of respective work elements, and a plurality of operator control elements the apparatus comprising:

means for sensing the speed of said source of motive power and delivering a signal representative of the actual speed in response to said sensed speed;

means for providing demand signals in response to selected settings of each respective operator control element;

first program means for calculating requested pump fluid flow through each of the control valves in response to the demand signals on respective lines, summing each of the requested flows, and delivering a signal having a value representative of total requested flow;

first means for receiving the total requested pump flow signal, determining desired speed of the source of motive power, and delivering a signal representative of the desired speed;

second means for comparing the desired and actual speed signals, and delivering an underspeed signal representative of the actual speed being less than the desired speed;

third means for receiving said actual speed signal and said underspeed signal, determing available flow capacity of said variable displacement pump, and delivering a signal representative of the available pump flow capacity; and second program means for comparing said total requested pump flow and said available pump flow capacity, delivering one of a plurality of requested and compensated signals in response to the total requested flow being respectively less than and greater than the available pump flow, controlling said fluid passing from said variable displacement pump to said respective work elements in response to receiving one of said requested and compensated signals, and maintaining total requested fluid flow within the available flow capacity of the variable displacement fluid pump.

12. Apparatus, as set forth in claim 11, wherein the second program means includes means for calculating said compensated signals in response to said total requested flow being greater than said total available flow.

13. Apparatus, as set forth in claim 11, wherein said second program means includes means for proportionally dividing the total available flow in response to said respective demand signals when the total requested flow is greater than the total available flow, and adjusting said control valves to correspond to said proportional division.

14. Apparatus, as set forth in claim 11, wherein said second program means includes means for proportionally dividing the total requested flow in response to said respective demand signals when the total available flow is greater than the total requested flow, and adjusting the control valves to correspond to said proportional division.

15. Apparatus, as set forth in claim 11, wherein the respective control valves have a substantially constant fluid pressure drop from said variable displacement pump to said respective work elements.

16. Apparatus, as set forth in claim 11, wherein said fluid system includes means for sensing load on said work elements, delivering load signals having values representative of the sensed load on each respective work element, receiving the load signals, and altering the flow from said variable displacement pump in response to the received load signals.

17. Apparatus, as set forth in claim 16, wherein said load sensing means includes means for adjusting the variable displacement pump for one of a greater flow and lesser flow in response to the load on said work elements respectively increasing and decreasing.

18. Apparatus, as set forth in claim 11, wherein said control valves includes an electrically actuatable valve opening means.

19. Apparatus, as set forth in claim 18, wherein said electrically actuatable valve opening means include electrohydraulic proportional pilot pressure valves for regulating pilot pressure delivered to said control valves.

20. An apparatus for controlling a fluid system of a hydraulic excavator having a source of motive power, a pilot pump connected to the source of motive power for delivering pressure signals and at least one fluid circuit having a variable displacement pump driven by the source of motive power, a plurality of work elements being connected through respective pressure compensated control valves to the discharge of the respective variable displacement pumps, proportional pilot pressure valves connected between the discharge of the pilot pump and the respective pressure compensated control valves, and a plurality of operator control elements connected to the respective proportional pilot pressure valves, the apparatus comprising:

means for sensing the speed of said source of motive power and delivering a signal representative of the actual speed in response to said sensed speed:

means for providing demand signals in response to selected settings of each respective operator control element and representative of operator demand;

means for calculating requested pump fluid flow through each of said control valves, in response to said respective demand signals and a substantially constant pressure drop across each of said control valves, and delivering a plurality of first signals representative of the requested pump fluid flow demand through each of said respective control valves;

means for summing the first signals, determining total requested pump fluid flow through each pump, and delivering a signal representative of the total requested pump fluid flow;

first means for determining desired speed of the source of motive power relative to the total requested pump fluid flow, and delivering a signal representative of the desired speed;

second means for comparing the desired and actual speed signals, and delivering an underspeed signal representative of the actual speed being less than the desired speed;

third means for receiving said actual speed and said underspeed signals, determining the total available flow capacity of each of said variable displacement pumps, and delivering a signal representative of the total available flow capacity for each pump;

fourth means for comparing said total requested flow to said total available flow signals, and delivering one of second and third signals in response to the total requested flow being respectively greater and less than the total available flow;

fifth means for receiving the third signal and delivering requested flow signals being maintained substantially equal to said operator demand;

sixth means for receiving the second signal, computing compensation factors for each of said requested flow signals and in direct proportion to said requested flow signals, reducing the total requested flow until substantially equal to said total available flow, and delivering compensated signals in response thereto;

seventh means for receiving the compensated signals and said requested signals, computing allowable valve areas and corresponding valve stem displacements for each control valve in response to the respective compensation signals and said respective requested signals, and delivering fourth signals representative of the valve stem displacements; and control means for delivering predetermined signals on lines to each of said respective pilot valves representative of the fourth signals, maintaining the total requested pump fluid flow through the control valves within the total available flow capacity of each of the variable displacement pumps, and controlling said pump fluid flow through each control valve substantially in direct proportion to said respective operator demand signal.

* * * * *